US010181648B2

(12) United States Patent
Liu

(10) Patent No.: US 10,181,648 B2
(45) Date of Patent: Jan. 15, 2019

(54) SELF-ADAPTIVE ANTENNA SYSTEM FOR RECONFIGURABLE DEVICE

(71) Applicant: Microsoft Technology Licensing, LLC, Redmond, WA (US)

(72) Inventor: Luyi Liu, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 156 days.

(21) Appl. No.: 15/097,106

(22) Filed: Apr. 12, 2016

(65) Prior Publication Data

US 2017/0294713 A1 Oct. 12, 2017

(51) Int. Cl.

| | |
|---|---|
| ***H01Q 1/24*** | (2006.01) |
| ***H01Q 9/14*** | (2006.01) |
| ***H01Q 1/22*** | (2006.01) |
| ***H01Q 7/00*** | (2006.01) |
| ***H01Q 5/378*** | (2015.01) |

(52) U.S. Cl.

CPC ..... *H01Q 9/145* (2013.01); *H01Q 1/2266* (2013.01); *H01Q 5/378* (2015.01); *H01Q 7/00* (2013.01); *H01Q 9/14* (2013.01)

(58) Field of Classification Search

None

See application file for complete search history.

(56) References Cited

U.S. PATENT DOCUMENTS

| | | | |
|---|---|---|---|
| 5,561,436 | A | 10/1996 | Phillips et al. |
| 6,327,485 | B1 | 12/2001 | Waldron |
| 6,720,936 | B1 | 4/2004 | Koolish et al. |
| 6,822,611 | B1 | 11/2004 | Kontogeorgakis et al. |
| 7,050,835 | B2 | 5/2006 | Hack et al. |
| 8,179,334 | B2 | 5/2012 | Pathak et al. |
| 8,421,683 | B2 | 4/2013 | Mak et al. |
| 2002/0113741 | A1 | 8/2002 | Asano et al. |
| 2002/0186169 | A1 | 12/2002 | Iwai et al. |
| 2003/0210206 | A1 | 11/2003 | Phillips et al. |
| 2005/0007283 | A1 | 1/2005 | Jo et al. |
| 2005/0026660 | A1 | 2/2005 | Park et al. |
| 2005/0113037 | A1 | 5/2005 | Ponce De Leon et al. |
| 2008/0303723 | A1 | 12/2008 | Bengtsson |
| 2009/0033566 | A1 | 2/2009 | Nakanishi et al. |
| 2009/0098827 | A1 | 4/2009 | Koyama |
| 2010/0214180 | A1* | 8/2010 | Krogerus ..... H01Q 1/243 343/702 |
| 2010/0279747 | A1 | 11/2010 | Imano et al. |

(Continued)

FOREIGN PATENT DOCUMENTS

| | | | |
|---|---|---|---|
| CN | 101036262 | A | 9/2007 |
| EP | 1635313 | A2 | 3/2006 |
| WO | 2006011254 | A1 | 2/2006 |

OTHER PUBLICATIONS

"International Search Report and Written Opinion Issued in PCT Application No. PCT/US17/026028", dated Jun. 23, 2017, 15 Pages.

(Continued)

*Primary Examiner* — Trinh Dinh

(74) *Attorney, Agent, or Firm* — Holzer Patel Drennan

(57) ABSTRACT

An electronic device disclosed herein includes an antenna that self-tunes frequency responsive to changes to a physical configuration of the electronic device to negate a shift in the resonant frequency attributable to the change in physical configuration.

8 Claims, 13 Drawing Sheets

(56) References Cited

U.S. PATENT DOCUMENTS

| | | | |
|---|---|---|---|
| 2011/0080703 | A1 | 4/2011 | Schlesener et al. |
| 2011/0227822 | A1 | 9/2011 | Shai |
| 2012/0009983 | A1 | 1/2012 | Mow et al. |
| 2012/0028692 | A1 | 2/2012 | Nishizono et al. |
| 2013/0241795 | A1 | 9/2013 | Sung et al. |
| 2013/0257661 | A1 | 10/2013 | Yuasa et al. |
| 2015/0085433 | A1 | 3/2015 | Kim |
| 2015/0123483 | A1 | 5/2015 | Leabman et al. |
| 2015/0133188 | A1 | 5/2015 | Chang et al. |

OTHER PUBLICATIONS

"International Search Report and Written Opinion Issued in PCT Application No. PCT/US2016/052376", dated Dec. 23, 2016, 14 Pages.

Purcher, Jack, "Samsung Invents a New Antenna System for Future Watch-Phones", Published on: Feb. 3, 2015 Available at: http://www.patentlymobile.com/2015/02/samsung-invents-a-new-antenna-system-for-future-watch-phones.html.

Anagnostou, et al., "A Direct-Write Printed Antenna on Paper-Based Organic Substrate for Flexible Displays and WLAN Applications", In Journal of Display Technology, vol. 6, No. 11, Nov. 2010, pp. 558-564.

Liyakath, Riaz Ahmed, "Reconfigurable Antenna and RF Circuits Using Multi-Layer Stretchable Conductors", In Master's Thesis, Jan. 2012, 120 pages.

Peckerar, et al., "Nanoparticle Technology for Power Integration with Flexible Substrates", Published on: Dec. 21, 2013 Available at: http://christou.umd.edu/documents/FlexElectronics.pdf.

Berger, Michael, "Flexible, carbon-based nanotechnology thin-film transistors", Published on: Jun. 5, 2013 Available at: http://www.nanowerk.com/spotlight/spotid=30782.php.

Gheethan, et al., "A Printed Paper-Based Inverted F-Antenna (PIFA) for WLAN Applications", In Proceedings of Flexible Electronics & Displays Conference and Exhibition, Feb. 2, 2009, 5 pages.

Olberding, et al., "PrintScreen: Fabricating Highly Customizable Thin-film Touch-Displays", In Proceedings of the 27th annual ACM symposium on User interface software and technology, Oct. 5, 2014, pp. 281-290.

Brown, Alan S., "Flexible electronics could transform the way we make and use electronic devices", Published on: Apr. 8, 2013 Available at: http://news.psu.edu/story/272086/2013/04/08/research/flexible-electronics-could-transform-way-we-make-and-use-electronic.

Khaleel, et al., "Design, Fabrication, and Testing of Flexible Antennas", In Proceedings of InTech Open Science, Mar. 6, 2013, pp. 363-383.

U.S. Appl. No. 14/883,254, Liu, Luyi, "Self-Adaptive Antenna Systems for Electronic Devices Having Multiple Form Factors", filed Oct. 14, 2015.

Zaman, et al., "Analysis of Resonance Response Performance of C-Band Antenna Using Parasitic Element", In Proceedings of the Scientific World Journal, vol. 2014, May 6, 2014, 7 pages.

Liu, et al., "Electrically Small Antenna Tuning Techniques", 2009 Loughborough Antennas & Propagation Conference, Loughborough, UK, Nov. 16-17, 2009, 4 pages.

* cited by examiner

SELF-ADAPTIVE ANTENNA SYSTEM FOR RECONFIGURABLE DEVICE

SUMMARY

Implementations described and claimed herein provide an electronic device with an antenna that self-tunes responsive to changes to a physical configuration of the electronic device.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

BRIEF DESCRIPTIONS OF THE DRAWINGS

DETAILED DESCRIPTIONS

Many modern devices are adapted for use in a variety of selectable physical configurations. For example, a laptop display may be detachable from a keyboard to facilitate usage of the display as a stand-alone tablet. Likewise, other devices can be folded and unfolded to select between different usable physical configurations. For example, some tablet computers may fold in half to compact for more convenient transport and/or facilitate use as phones in the compact, folded form.

Altering a physical configuration of an electronic device can, in some cases, inadvertently alter the resonance frequency of one or more device antennas, such as by placing extra loading material in a region proximal to the antenna. Consequently, an antenna that works well in one physical configuration may experience a resonance frequency shift that decreases performance of the antenna in a target frequency band when the electronic device is placed in a second physical configuration.

The herein disclosed technology addresses the foregoing by providing a self-adaptive antenna system that self-tunes to permit resonance at a same frequency despite a change to a physical configuration of the electronic device.

Figure 1:
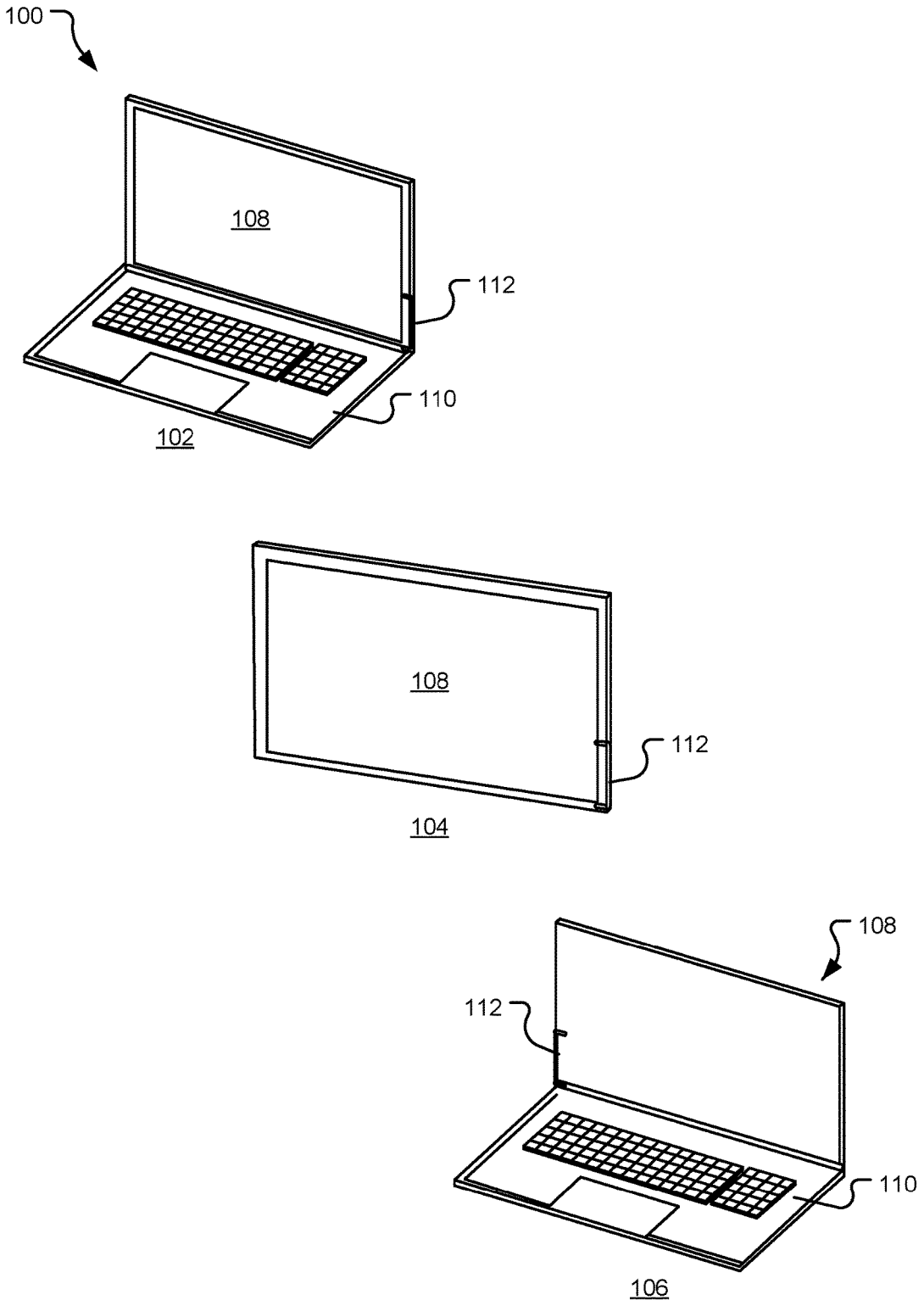
FIG. 1 illustrates an example electronic device including a self-adaptive antenna system.

FIG. 1 illustrates an example electronic device 100 including a self-adaptive antenna system. The electronic device 100 is shown arranged in three different physical configurations 102, 104, and 106, each facilitating a different method of use for the electronic device 100. In the physical configuration 102, the electronic device 100 is configured for use as a laptop computer with a display 108 attached to a keyboard 110. The display 108 is positioned to face inward toward a user positioned to type on the keyboard 110. The electronic device 100 includes at least one antenna (e.g., an antenna 112), and in some cases includes multiple antennas configured to transmit in different frequency bands to facilitate different device functions. The antenna 112 may be a single band antenna or a multiple-band antenna with self-tuning features for tuning in one or multiple frequency bands. In one implementation, the antenna 112 includes a radiating element designed to resonate in a target frequency band.

In the physical configuration 104, the display 108 is shown detached from the keyboard 110, in a manner such that the electronic device 100 is reconfigured for use as a tablet computer. Due to the absence of the keyboard 110, there is less material in the vicinity of the antenna 112. The absence of this material may, if not otherwise corrected for, change the resonant frequency of the antenna 112 and shift the resonant frequency of the antenna 112 off the target frequency band. In one implementation, the antenna 112 self-tunes responsive to the change in physical configuration (e.g., between laptop mode and tablet mode) to maintain a resonance of the antenna 112 within a same target frequency band.

In the physical configuration 106, the display 108 is shown reattached to the keyboard 110 but the screen of the display 108 faces away from the keyboard 110 and is opposite that shown in the physical configuration 102. This physical configuration 106 is referred to herein as "presentation mode," and is just another one of a number of other example physical configurations for which the antenna 112 may self-tune resonant frequency. Without tuning, the antenna 112 may, in some implementations, perform differently in presentation mode (e.g., the physical configuration 106) than in laptop mode (e.g., the physical configuration 102). If, for example, the antenna 112 is formed on or attached to glass of the display 108, the antenna 112 is closer to the keyboard 110 in laptop mode than in presentation mode. If not corrected for, this change in proximity between the antenna 112 and material of the keyboard 110 may influence the resonant frequency of the antenna 112 and cause the antenna 112 to resonate at a frequency outside of the target frequency band.

In different implementations, the electronic device 100 can be physically reconfigured in a variety of ways, including without limitation turning, twisting, or rotating of various component(s). A variety of mechanisms can be employed to facilitate self-tuning of the antenna 112 responsive to changes in the physical configuration of the electronic device 100, such as changes to and from the various physical configurations 102, 104, and 106 shown in FIG. 1. In one implementation, tuning is accomplished by selectively coupling or decoupling a radiating element of the antenna with a self-adaptive tuning element. For example, a radiating element may couple to a self-adaptive tuning element in some physical configurations of the electronic device 100 to effectively extend a radiating length of the antenna 112. In other implementations, a radiating element may couple to a self-adaptive tuning element to shift a position of a signal feed relative to the radiating element and/or to create or remove an electrical short at a location along a radiating length of the antenna 112. Several non-inclusive examples are discussed below.

Figure 2:
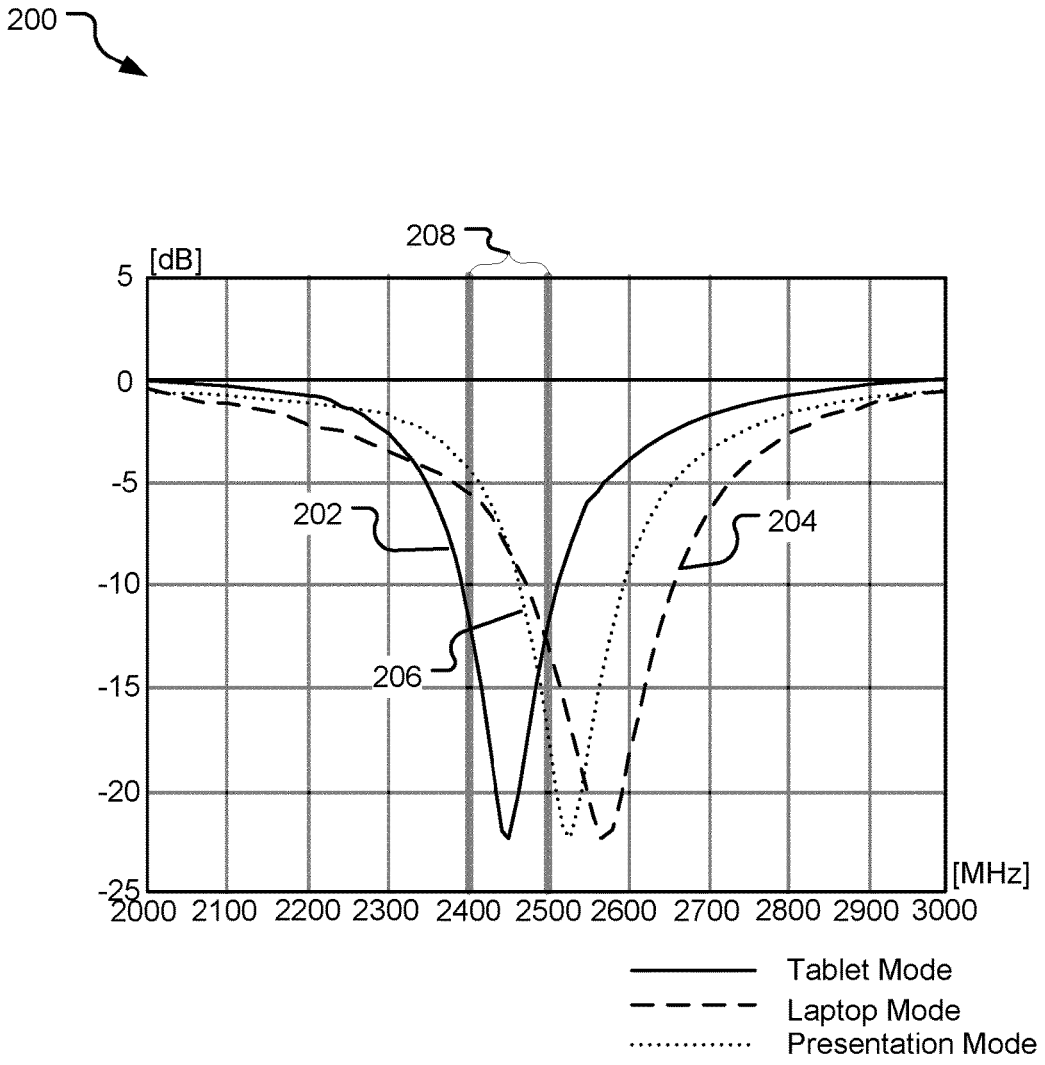
FIG. 2 illustrates an example plot indicating performance of an antenna in an electronic device configured for use in each of three different physical configurations.

FIG. 2 illustrates an example plot 200 indicating performance of an antenna in an electronic device configured for use in each of three different physical configurations. The plot 200 is based on data from an antenna that does not self-tune responsive to changes in the physical configuration of the associated electronic device. A first line 202 illustrates a resonant frequency of the antenna when the electronic device is configured for use as a tablet (e.g., in "tablet mode"); a second line 204 illustrates a resonant frequency of the antenna when the electronic device is configured for use as a laptop (e.g., in "laptop mode"); and a third line 206 illustrates a resonant frequency of the antenna when the electronic device is configured to give a presentation (e.g., in "presentation mode").

As shown by the line 202, the antenna exhibits peak resonance within a target frequency band 208 when the electronic device is in tablet mode. When, however, the physical configuration of the electronic device is altered from tablet mode to presentation mode, the peak resonance of the antenna shifts off of the target frequency band 208, as shown by the line 206. When the electronic device is selectively placed in the laptop mode, the peak resonance of the antenna shifts even further away from the target frequency band 208, as shown by the line 204.

When the antenna is designed to self-tune per the technology disclosed herein, there is little or no discernable "shifting" of the resonant frequency of the antenna when the electronic device is selectively placed into each of the tablet mode, presentation mode, and laptop mode. Regardless of device configuration, the antenna may continue to resonate within the target frequency band 208.

Figure 3:
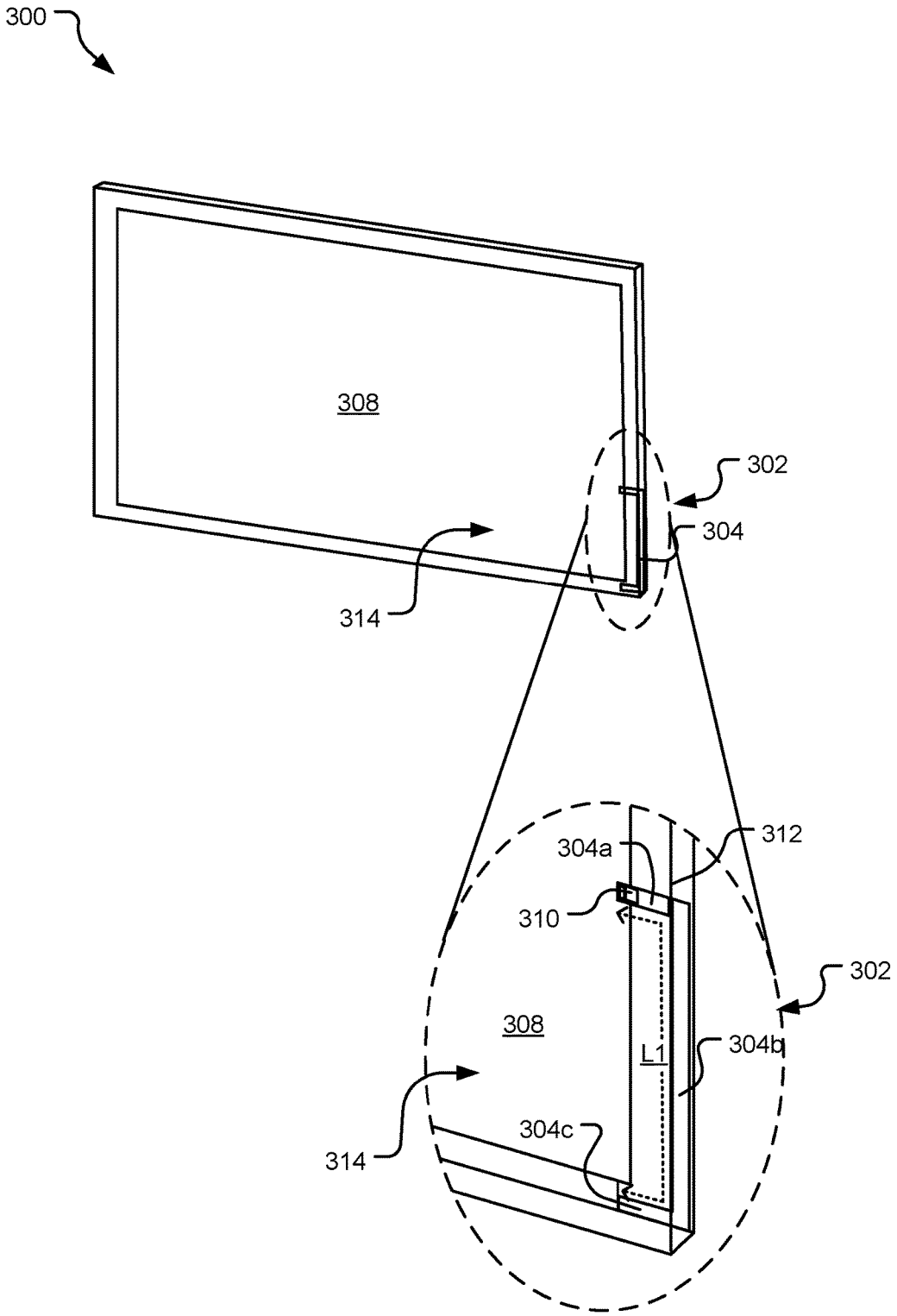
FIG. 3 illustrates an example electronic device with a self-adaptive antenna that self-tunes a frequency of resonance responsive to changes in physical configuration of the electronic device.

FIG. 3 illustrates an example electronic device 300 with a self-adaptive antenna 302 that self-tunes a frequency of resonance responsive to changes in physical configuration of the electronic device 300. The self-adaptive antenna 302 includes a conductive radiating element 304 proximal to a corner of a display 308 of the electronic device 300. Specifically, the conductive radiating element 304 is a loop antenna that includes electrically connected first, second, and third radiating portions 304*a*, 304*b*, and 304*c*. The first and second radiating portions 304*a* and 304*b*, 304*c* are all positioned on or below a front surface 314 of the display 308, such as below glass of the display 308.

The self-adaptive antenna 304 includes a feed element 310. The feed element 310 is shown positioned proximal to display glass on the front surface of the display 308, but may, in other implementations, assume a variety of alternative positions. In various implementations, the conductive radiating element 304 may be formed from a single conductive component or multiple conductive, electrically connected components.

In FIG. 3, the electronic device 300 is shown in a first physical configuration that supports functionality of the electronic device 300 as a tablet. In this physical configuration, the conductive radiating element 304 has an end-to-end length L1. In one implementation, the end-to-end length L1 is specifically engineered to cause the conductive radiating element 304 to resonate within a target resonant frequency band when the electronic device 300 is used as a tablet computer (e.g., in tablet mode).

The end-to-end length L1 of the conductive radiating element 304 is equal to a radiating length of the self-adaptive antenna 302 when the electronic device is used as a tablet computer (as shown). As used herein, the term "radiating length" refers to a length of the self-adaptive antenna 302 that may resonate to transmit a radio frequency (RF) signal. In some physical configurations of the electronic device 300, the self-adaptive antenna 302 may self-tune and thereby alter the radiating length of the self-adaptive antenna 302 to be longer or shorter than the end-to-end length L1 of the conductive radiating element 304.

The feed element 310 is further coupled to a transmitter (not shown) that supplies an RF signal to the self-adaptive antenna 302. As discussed above with respect to FIG. 2, the resonant frequency of the self-adaptive antenna 302 may shift away from a target frequency band when the electronic device 300 is reconfigured for other physical configurations of use. In one implementation, the self-adaptive antenna 302 self-tunes to adjust the resonant frequency of the conductive radiating element 304 when the electronic device 300 is placed in a new physical configuration. For example, the self-adaptive antenna 302 may self-tune its resonant frequency by altering its radiating length. Examples elaborating on this concept are further explored below with respect to FIGS. 4 and 5.

Figure 4:
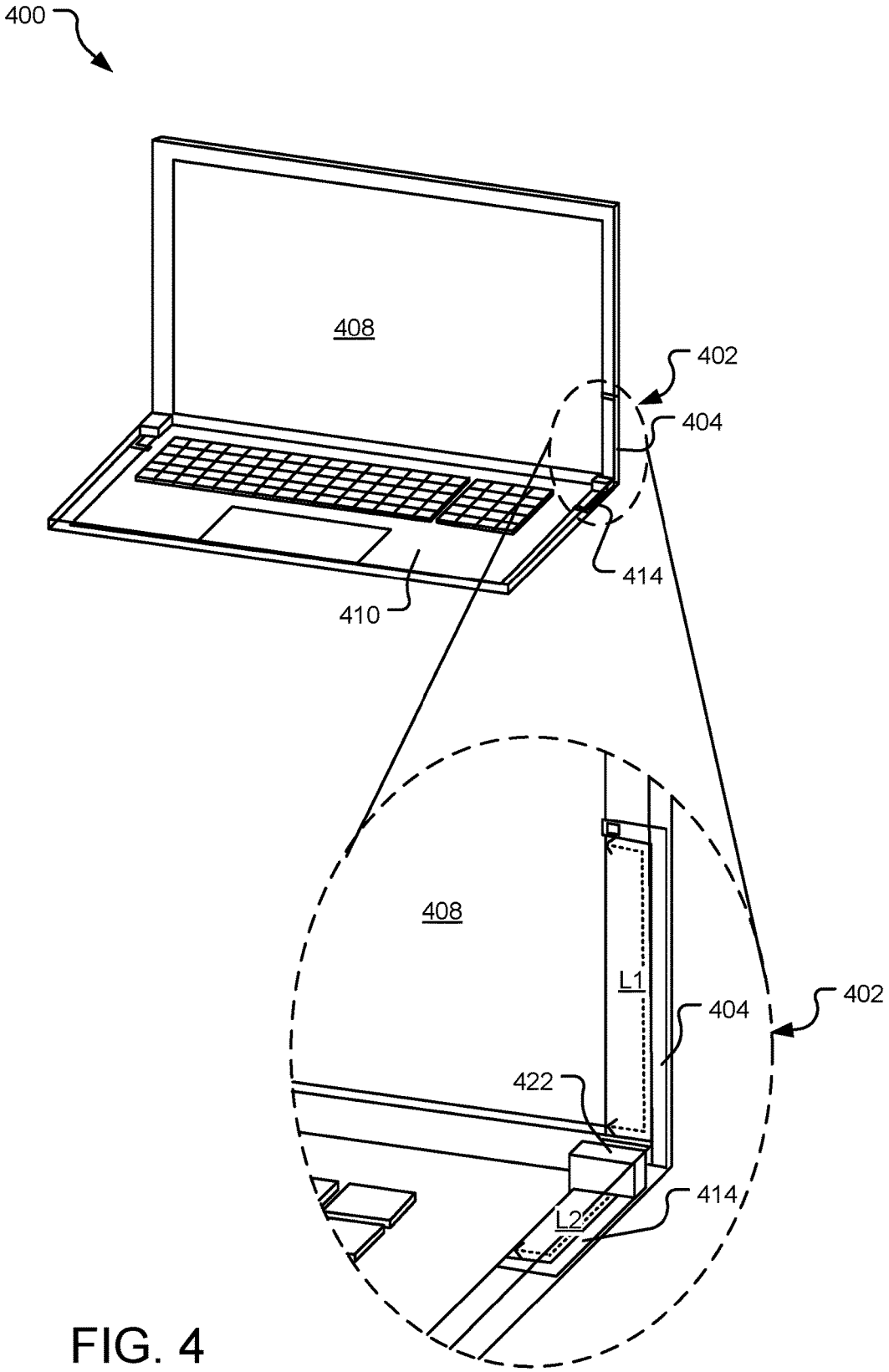
FIG. 4 illustrates another example electronic device with a self-adaptive antenna that self-tunes a frequency of resonance responsive to changes in physical configuration of the electronic device.

FIG. 4 illustrates another example electronic device 400 with a self-adaptive antenna 402 that includes a conductive radiating element 404 and a self-adaptive tuning element 414 for self-tuning a frequency of resonance responsive to changes in physical configuration of the electronic device 400. The conductive radiating element 404 is included in a display portion 408 of the electronic device 400 and includes features specifically designed for resonance within a target frequency band when the electronic device 400 is used in a default physical configuration, such as a tablet mode. For example, the target resonant frequency band may be a band that supports LTE, Wi-Fi, GPS, 4G, 3G, Bluetooth, etc. The self-adaptive tuning element 414 is formed in a keyboard portion 410 of the electronic device 400 and includes features specifically designed to adjust the radiating length of the self-adaptive antenna 402 to offset a shift in resonant frequency observable when the electronic device 400 is reconfigured from the default use mode (e.g., a tablet mode) to a laptop mode, as shown.

When the electronic device 400 is configured for use in laptop mode (as shown), the self-adaptive tuning element 414 couples to the conductive radiating element 404 to extend a radiating length of the self-adaptive antenna 402 and thereby tune a resonant frequency of the self-adaptive antenna 402. For example, the coupling between the conductive radiating element 404 and the self-adaptive tuning element 414 may effectively extend the radiating length of the self-adaptive antenna 402 to equal a sum of an end-to-end length L1 of the conductive radiating element 404 and an end-to-end length L2 of the self-adaptive tuning element 414. In FIG. 4, a ceramic block 422 capacitively couples the conductive radiating element 404 and the self-adaptive tuning element 414, extending the effective radiating length of the self-adaptive antenna 402 to L1 plus L2, or the combined length of the two components.

When the keyboard portion 410 is coupled to the display portion 408 (as shown), material of the keyboard incidentally affects a resonate frequency of the conductive radiating element 404. Without some mechanism for self-tuning, this shift in resonant frequency may be significant enough to negatively impact performance of the self-adaptive antenna 402. However, the illustrated coupling between the conductive radiating element 404 and the self-adaptive tuning element 414 acts to negate any incidental shift in resonant frequency so that the self-adaptive antenna 402 may continue to resonate within a target frequency band despite changes in the device configuration between laptop mode, a default use mode (e.g., tablet mode), and any other number of modes representing different physical configurations of use.

Notably, some implementations may not include the ceramic block 422. For example, the self-adaptive tuning element 414 may include another mechanism for adjusting the radiating length of the self-adaptive antenna 402. In one implementation, the self-adaptive tuning element 414 couples to the conductive radiating element 404 to create or remove an electrical short along the end-to-end length L1. In still another implementation, coupling of the conductive radiating element 404 to the self-adaptive tuning element 414 effectively shifts a location of a feed point relative to the conductive radiating element 404.

Figure 5:
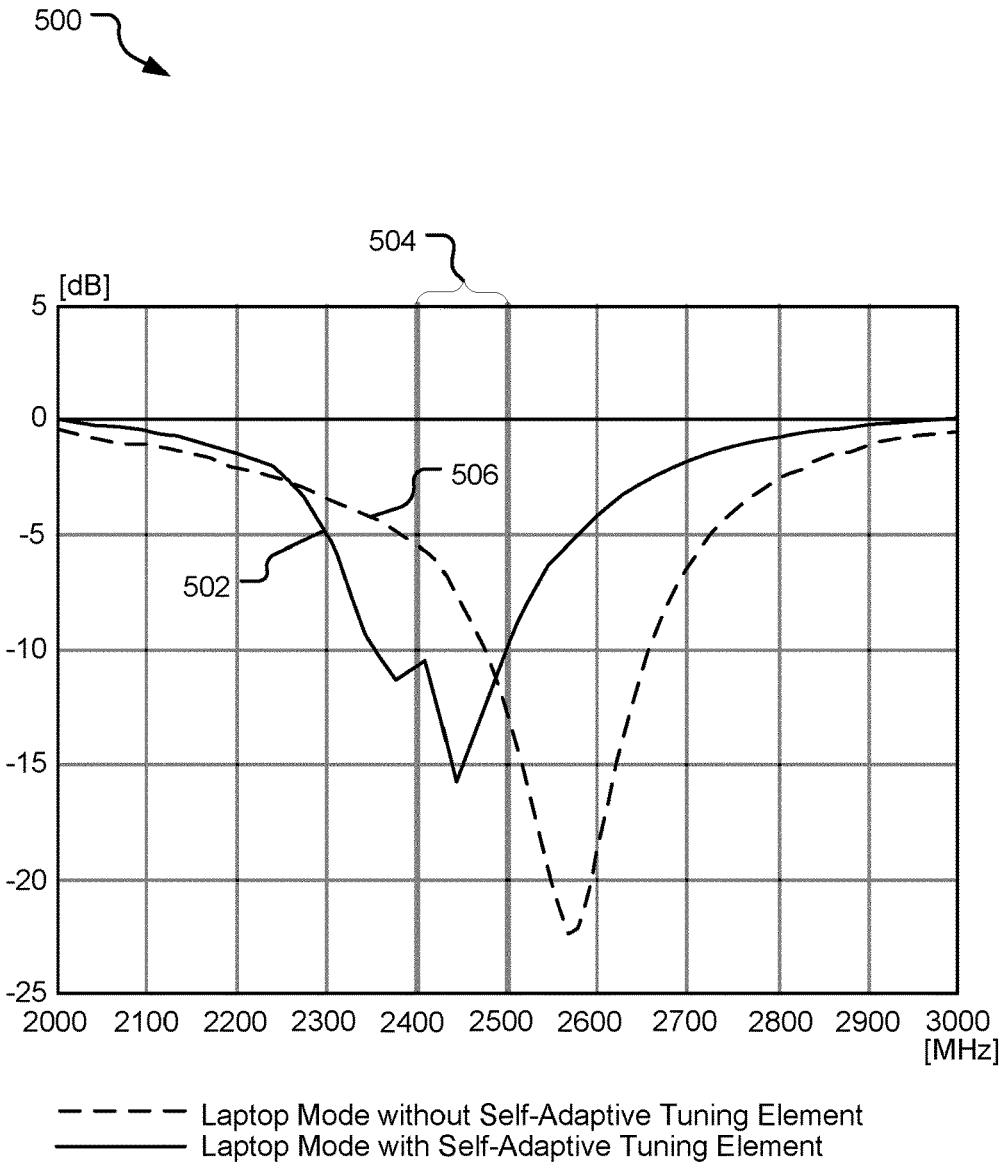
FIG. 5 illustrates an example plot indicating performance of a self-adaptive antenna and a non-self-adaptive antenna in identical reconfigurable electronic devices.

FIG. 5 illustrates an example plot 500 indicating performance of a self-adaptive antenna and a non-self-adaptive antenna in identical electronic devices and identical modes. Specifically, a line 506 illustrates performance of the non-self-adaptive antenna and a line 502 illustrates performance of the self-adaptive antenna when the electronic devices are place in a "laptop mode." Both the self-adaptive antenna and the non-self-adaptive antenna include a conductive radiating element (e.g., such as the conductive radiating element 404 of FIG. 4) that is designed to resonate in a target frequency band 504 when the electronic device is used in a default use mode corresponding to a physical configuration different from laptop mode, such as a tablet mode. Unlike the non-self-adaptive antenna, the self-adaptive antenna further includes a self-adaptive tuning element that couples to the conductive radiating element responsive to physical reconfiguration of the electronic device from the default mode to the laptop mode.

As shown by the line 506, peak resonance of the non-self-adaptive antenna shifts off the target frequency band 504 when the electronic device is used in laptop mode rather than the default use mode, decreasing performance. As further shown by the line 502, peak resonance of the self-adaptive antenna does not shift off the target frequency band 504 when the electronic device is used in laptop mode as compared to the default use mode.

Figure 6:
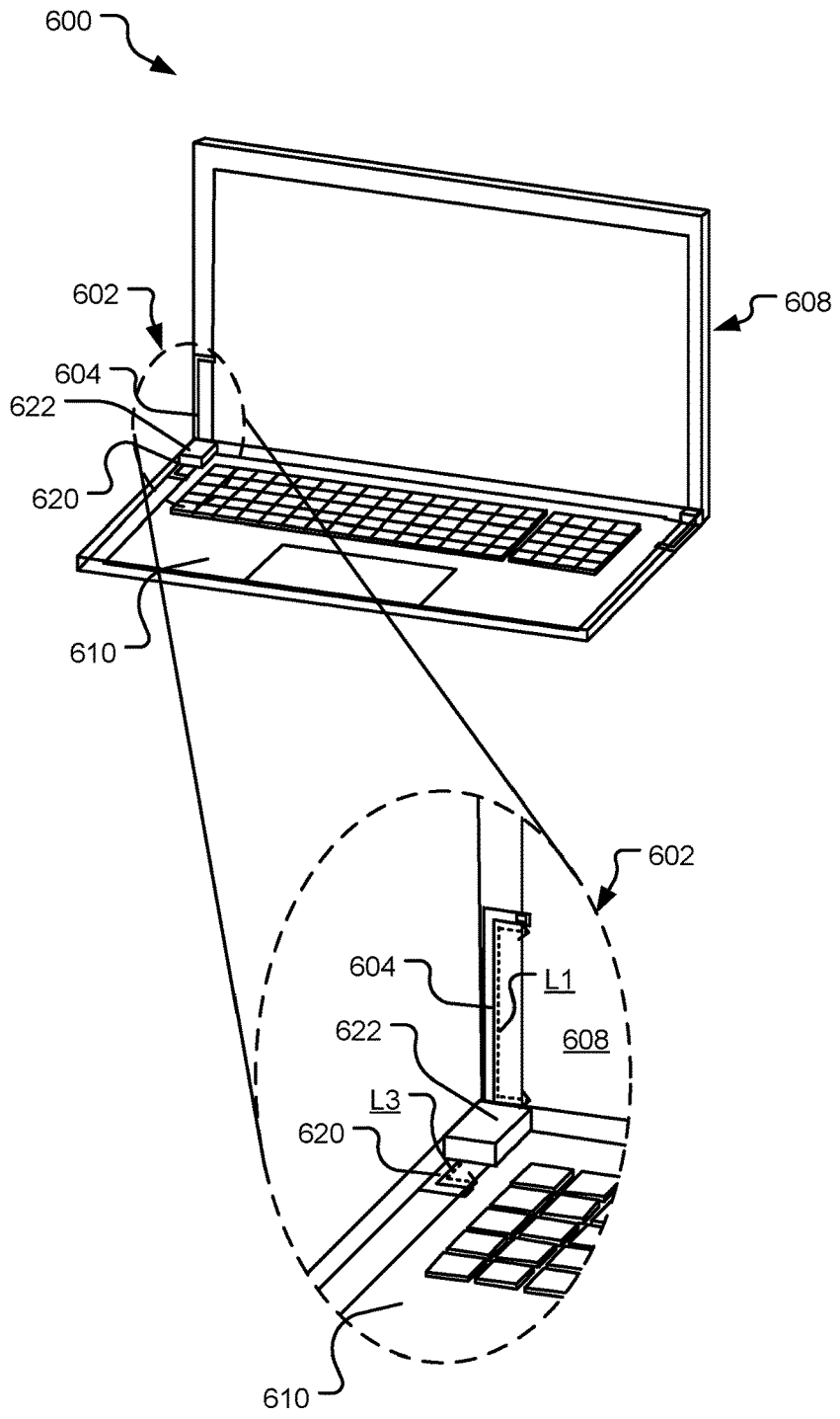
FIG. 6 illustrates another example electronic device with a self-adaptive antenna that self-tunes a frequency of resonance responsive to changes in physical configuration of the electronic device.

FIG. 6 illustrates another example electronic device 600 with a self-adaptive antenna 602 that includes a conductive radiating element 604 and a self-adaptive tuning element 620 for self-tuning a frequency of resonance responsive to changes in physical configuration of the electronic device 600. The conductive radiating element 604 is included in a display portion 608 of the electronic device 600 and includes features specifically designed for resonance within a target frequency band when the electronic device 600 is used in a default use mode, such as a tablet mode. The self-adaptive tuning element 620 is formed in a keyboard portion 610 of the electronic device 600 and includes features specifically designed to adjust the radiating length of the self-adaptive antenna 602 to offset a shift in resonant frequency observable when the electronic device 600 is reconfigured from the default use mode (e.g., a tablet mode) to a presentation mode whereby the electronic device 600 is configured with a display 608 facing away from the keyboard 610, as shown.

When the electronic device 600 is configured for use in presentation mode, as shown, the self-adaptive tuning element 620 couples to the conductive radiating element 604 to extend a radiating length of the self-adaptive antenna 602 and thereby tune a resonant frequency of the self-adaptive antenna 602. For example, the coupling between the conductive radiating element 604 and the self-adaptive tuning element 620 may effectively extend a radiating length of the self-adaptive antenna 602 to equal a sum of an end-to-end length L1 of the conductive radiating element 604 and an end-to-end length L3 of the self-adaptive tuning element 620. For example, a ceramic block 622 may act to capacitively the conductive radiating element 604 and the self-adaptive tuning element 620.

In one implementation, the conductive radiating element 604 couples to the self-adaptive tuning element 620 when the electronic device 600 is placed in presentation mode, but couples to another self-adaptive tuning element (e.g., 414 of FIG. 4) when the electronic device 600 is placed in laptop mode. The self-adaptive tuning element used in laptop mode (e.g., 414 in FIG. 4) may have some characteristics different from the self-adaptive tuning element 620 used in presentation mode. For example, the length of the self-adaptive tuning element 620 may vary in different implementations. In addition, the size or electrical property of the ceramic block 622 and/or other ceramic blocks on the electronic device 600 may be varied in different implementations as well as in different modes (physical configurations) of the same implementation to influence desired coupling and radiation characteristics. These different coupling and radiation characteristics may, for example, account and correct for resonance effects attributable to small differences in proximity between the keyboard portion 610 and the conductive radiating element 604 in laptop mode and presentation mode, respectively.

Some implementations may not include the ceramic block 622. For example, the self-adaptive tuning element 620 may include another mechanism for coupling to the conductive radiating element 604. In one implementation, the self-adaptive tuning element 620 couples to the conductive radiating element 604 in a manner that creates or removes an electrical short along the end-to-end length L1. In still another implementation, coupling of the conductive radiating element 604 to the self-adaptive tuning element 620 effectively shifts a location of a feed point relative to the conductive radiating element 604. For example, altering a physical location of the electronic device 600 may cause a switch to flip that changes a location of an antenna feed point.

Figure 7:
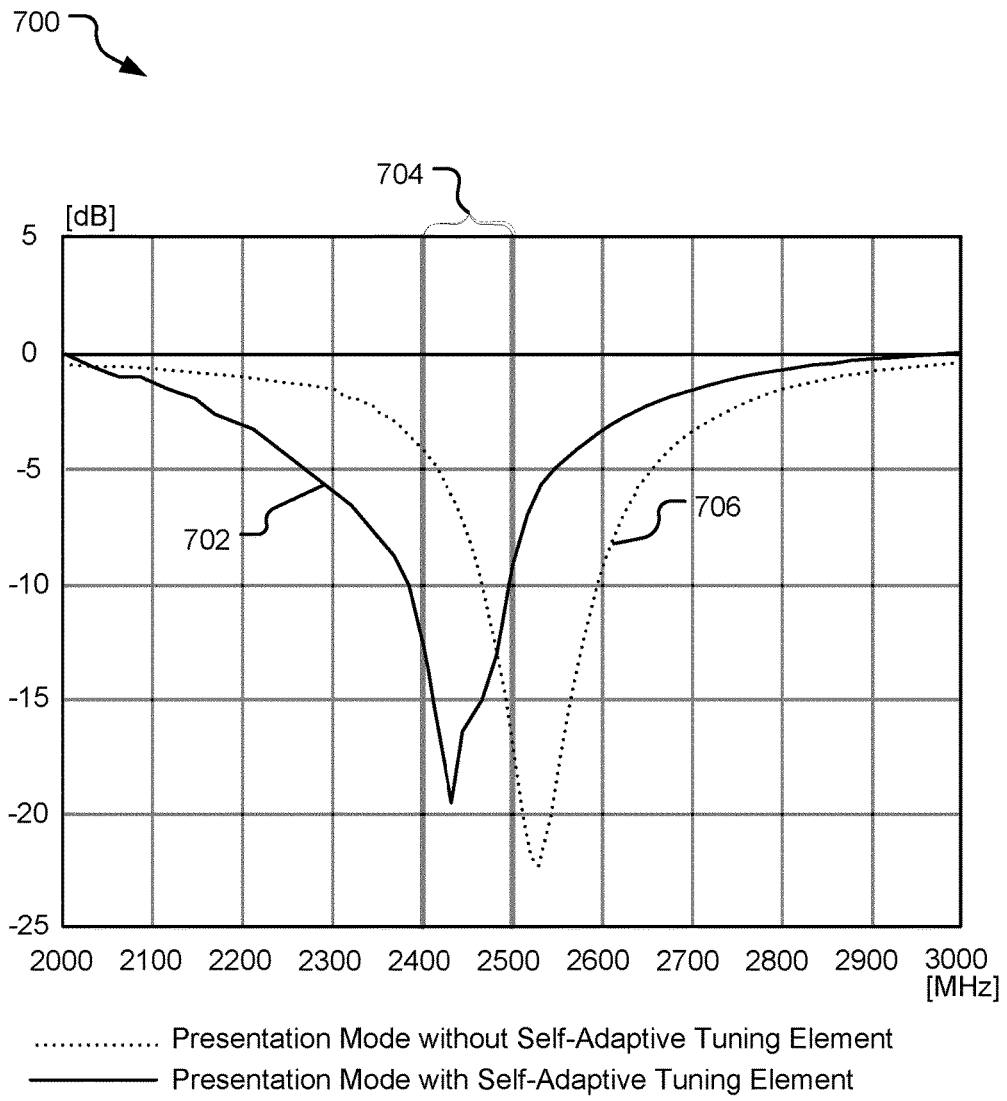
FIG. 7 illustrates another example plot indicating performance of a self-adaptive antenna and a non-self-adaptive antenna in identical reconfigurable electronic devices.

FIG. 7 illustrates an example plot 700 indicating performance of a self-adaptive antenna and a non-self-adaptive antenna integrated into identical reconfigurable electronic devices when placed in a presentation mode (e.g., with a display screen facing away from a keyboard as shown in FIG. 6). Specifically, a line 706 illustrates performance of the non-self adaptive antenna and a line 702 illustrates performance of the self-adaptive antenna. Both the self-adaptive antenna and the non-self-adaptive antenna include a conductive radiating element that is designed to resonate in a target frequency band 704 when the electronic device is used in a default use mode different from presentation mode, such as tablet mode. Unlike the non-self-adaptive antenna, the self-adaptive antenna further includes a self-adaptive tuning element that couples to the conductive radiating element responsive to physical reconfiguration of the electronic device from the default mode to the presentation mode.

As shown by the line 706, peak resonance of the non-self-adaptive antenna shifts off the target frequency band 704 when the electronic device is used in presentation mode rather than the default mode, decreasing performance. As further shown by the line 702, peak resonance of the self-adaptive antenna does not shift off the target frequency band 704 when the electronic device is used in presentation mode as compared to the default mode.

Figure 8:
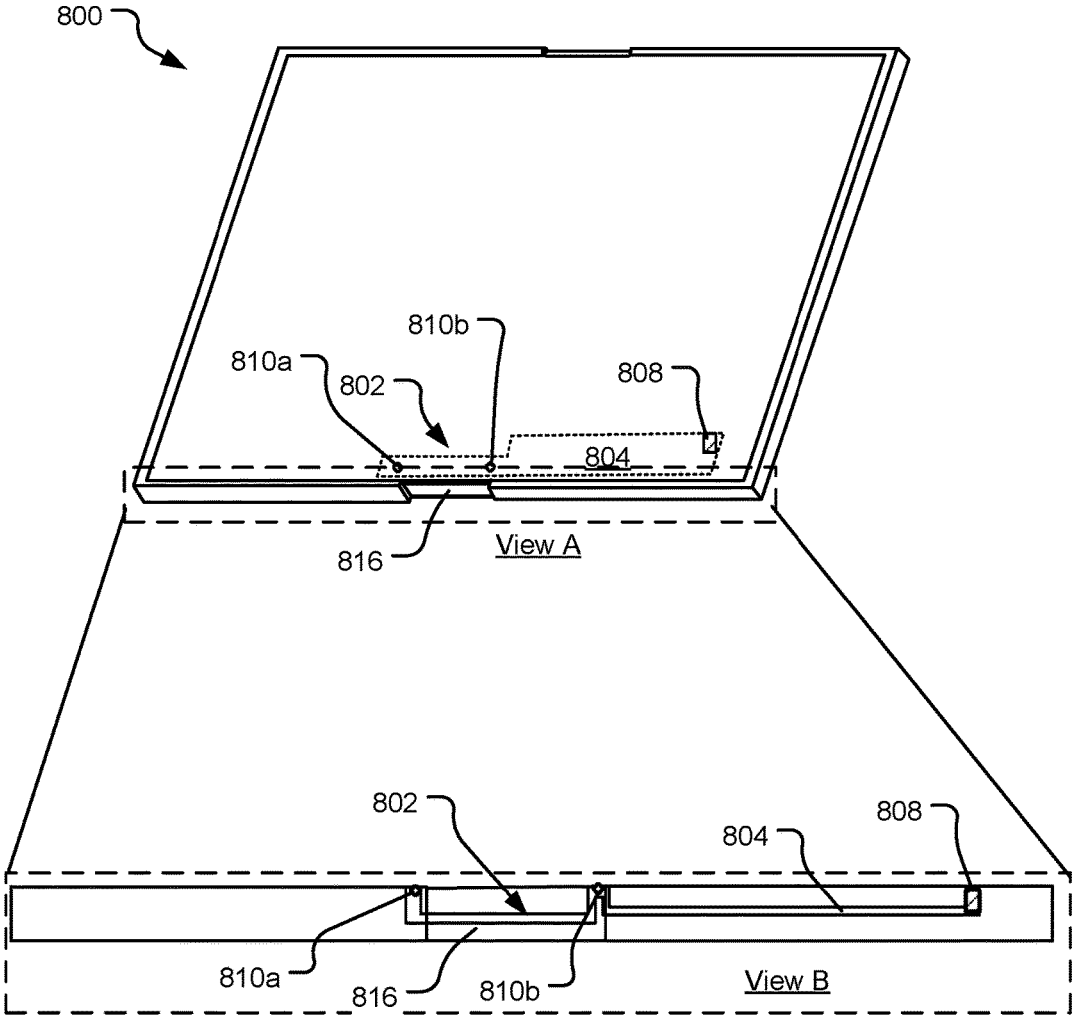
FIG. 8 illustrates another example electronic device with a self-adaptive antenna that self-tunes a frequency of resonance responsive to a physical configuration change between a folded and unfolded mode of the electronic device.

FIG. 8 illustrates another example electronic device 800 with a self-adaptive antenna 802 that tunes a frequency of resonance responsive to changes in physical configuration of the electronic device 800. In one implementation, the self-adaptive antenna 802 self-tunes responsive to a change between first and second physical configurations of the electronic device 800, such as a change between an unfolded mode (as shown) and a folded mode (e.g., a shown in FIG. 9).

The self-adaptive antenna 802 of FIG. 8 includes a radiating element 804 positioned beneath an exterior surface of the electronic device 800, as indicated by dotted lines in perspective View A and shown in greater detail in View B, which is an expanded cross-sectional side view. In one implementation, all or some of the self-adaptive antenna 802 is embedded beneath an insulating bezel (e.g., a plastic bezel) forming a surface perimeter on the electronic device 800. A first end of the radiating element 804 includes a feed point 808.

Figure 9:
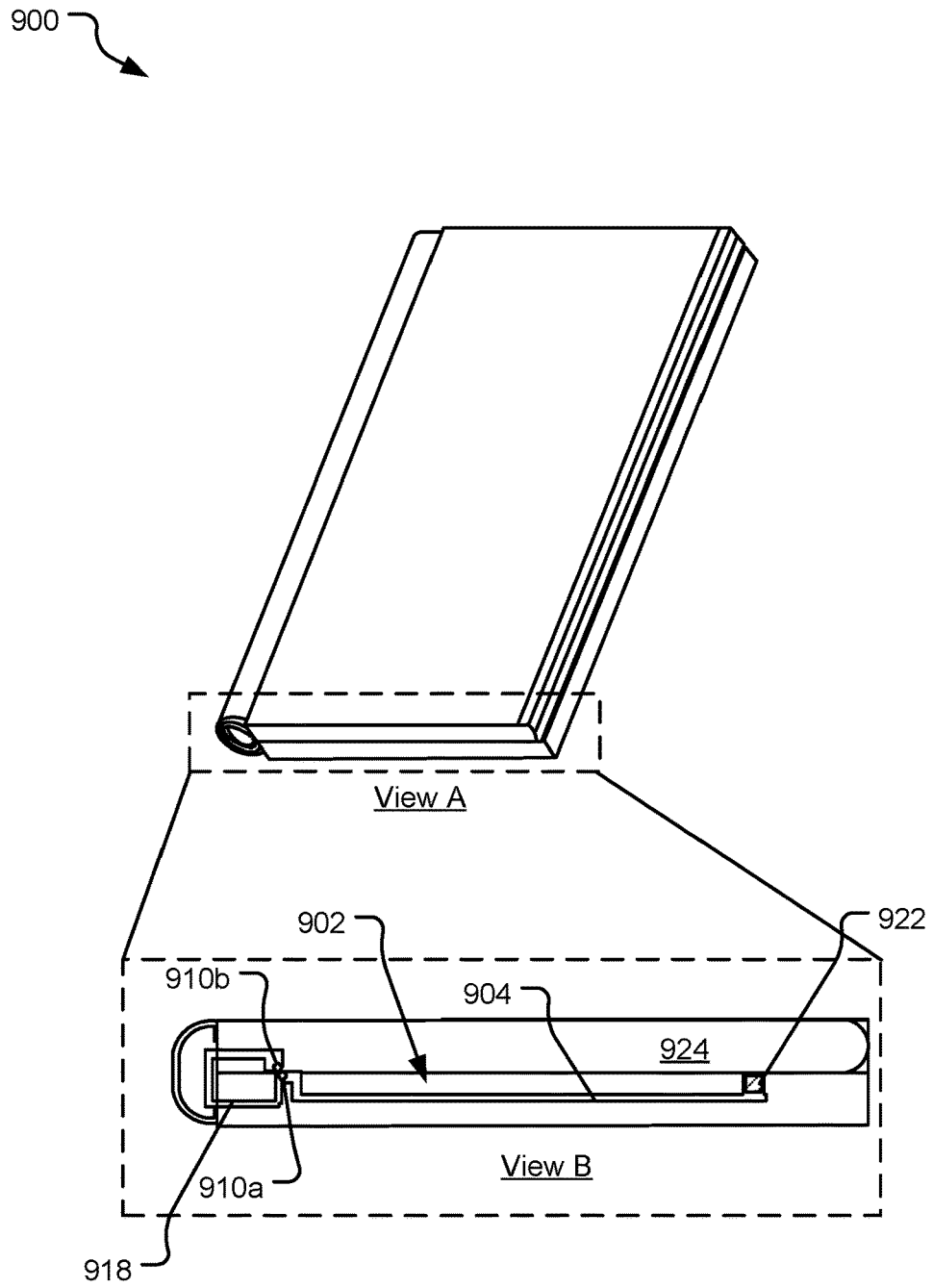
FIG. 9 illustrates another example electronic device with a self-adaptive antenna that self-tunes a frequency of resonance responsive to a physical configuration change between a folded and unfolded mode of the electronic device.

When the electronic device 800 is in the unfolded mode (as shown), an end-to-end length of the radiating element 804 equals a radiating length of the self-adaptive antenna 802. When, however, the electronic device 800 is placed into a folded position (as shown in FIG. 9), the radiating length of the self-adaptive antenna 802 is shortened by a predetermined amount due to the coupling of electrodes 810*a*, 810*b* (e.g., one example self-tuning element). This truncation of the radiating length prevents the resonant frequency of the self-adaptive antenna 802 from shifting off of a target frequency band when the electronic device 800 is folded, as discussed in greater detail with respect to FIG. 9.

The radiating element 804 spans a hinge 816 of the electronic device 800 and may therefore be made of a generally flexible material. In various implementations, the electrodes may be selectively positioned in different places and/or formed of colored materials to match the surrounding display of the electronic device 800.

FIG. 9 illustrates another example electronic device 900 with a self-adaptive antenna 902 that self-tunes a frequency of resonance responsive to changes in physical configuration of the electronic device 900. In one implementation, the self-adaptive antenna 902 self-tunes responsive to a change between first and second physical configurations of the electronic device 900, such as a change between an unfolded mode (e.g., as shown in View A of FIG. 8) and a folded mode (as shown in View A of FIG. 9).

View B is an expanded cross-sectional side view of the electronic device 900 shown in View A, and illustrates a radiating element 904 positioned generally beneath an exterior surface of the electronic device 900. A first end of the radiating element 904 includes a feed point 922.

When the electronic device 900 is folded, as shown, additional loading material 924 increases antenna impedance, an affect that tends to shift the natural resonant frequency of the self-adaptive antenna 902 as compared to the resonant frequency of the self-adaptive antenna 902 when the electronic device 900 is in an unfolded position. However, the self-adaptive antenna 902 includes electrodes 910*a* and 910*b* that couple together in the folded position to effectively shorten the radiating length of the self-adaptive antenna 902 by a predetermined amount. As a result, the resonant frequency of the self-adaptive antenna 902 is maintained within a target frequency band regardless of the physical configuration (e.g., folded or unfolded) of the electronic device 900. When folded as shown, a loop portion 918 of the self-adaptive antenna 902 contributes very little to radiation of the self-adaptive antenna.

Figure 10:
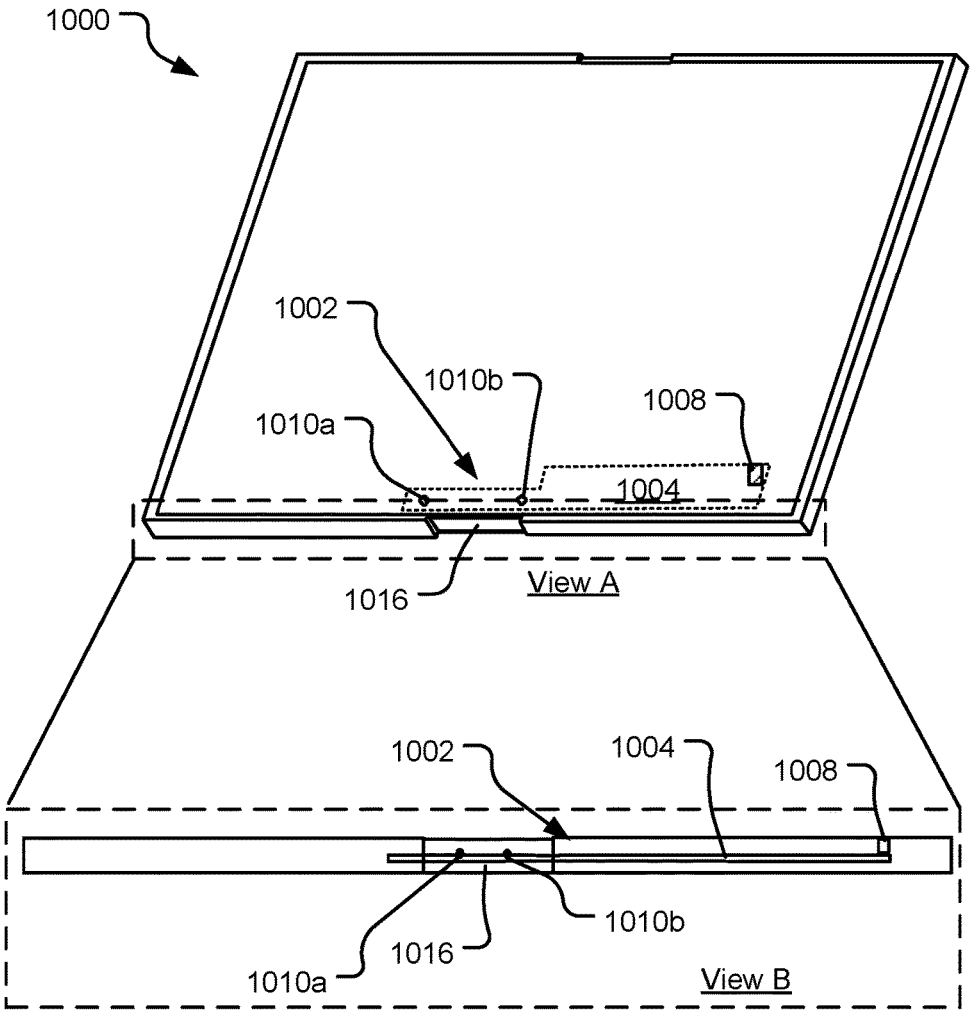
FIG. 10 illustrates another example electronic device with a self-adaptive antenna that self-tunes a frequency of resonance responsive to a physical configuration change between a folded and unfolded mode of the electronic device.

FIG. 10 illustrates another example electronic device 1000 with a self-adaptive antenna 1002 that self-tunes a frequency of resonance responsive to changes in physical configuration of the electronic device 1000. The self-adaptive antenna 1002 self-tunes responsive to a change between unfolded and folded physical configurations of the electronic device 1000, such as a change between the illustrated unfolded mode (as shown) and a folded mode (e.g., as shown in FIG. 11).

The self-adaptive antenna 1002 of FIG. 10 includes a radiating element 1004 positioned beneath an exterior surface of the electronic device 1000, as indicated by dotted lines in perspective View A and shown in greater detail in View B, which is an expanded cross-sectional side view. A first end of the radiating element 1004 includes a feed point 1008. When the electronic device 1000 is in the unfolded mode (as shown), an end-to-end length of the radiating element 1004 equals its radiating length. When, however, the electronic device 1000 is placed into a folded position (e.g., as shown and described with respect to FIG. 11), the radiating length is effectively shortened. Specifically, the radiating length is shorted by a self-tuning element in the form of electrodes 1010*a*, 1010*b* that electrically couple together. Unlike the electronic devices of FIGS. 8 and 9, the electrodes 1010*a*, 1010*b* of FIG. 10 are internal to the electronic device and within a hinge area 1016.

Figure 11:
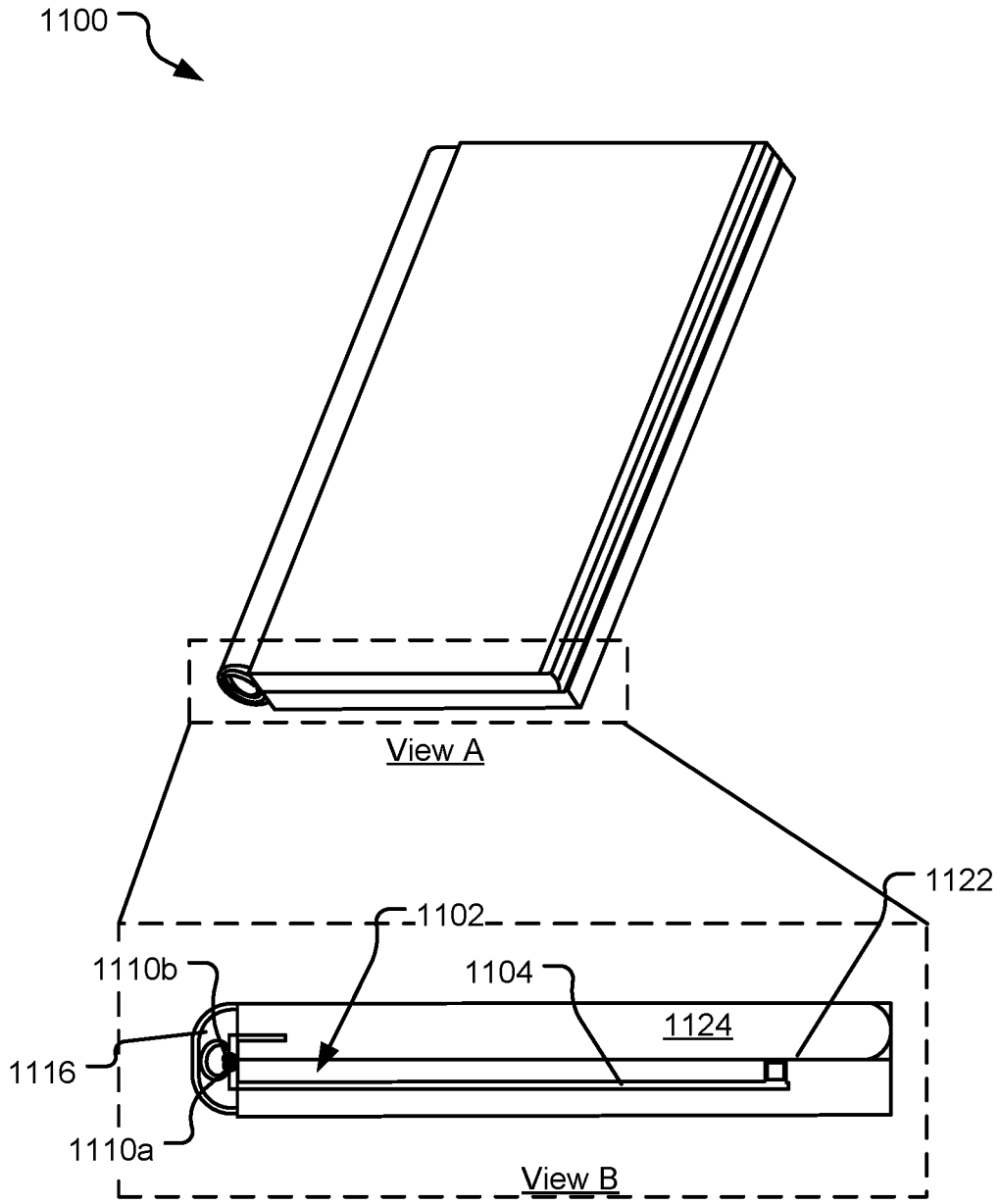
FIG. 11 illustrates another example electronic device with a self-adaptive antenna that self-tunes a frequency of resonance responsive to a physical configuration change between a folded and unfolded mode of the electronic device.

FIG. 11 illustrates another example electronic device 1100 with a self-adaptive antenna 1102 that self-tunes a frequency of resonance responsive to changes in physical configuration of the electronic device 1100. View A illustrates a perspective view of the electronic device 1100, while View B illustrates an expanded cross-sectional side view of the electronic device 1100. The self-adaptive antenna 1102 includes a radiating element 1104 positioned generally beneath an exterior surface of the electronic device 1100, as shown in View B. A first end of the radiating element 1104 includes a feed point 1122. When the electronic device 1100 is folded, as shown, additional loading material 1124 increases impedance, shifting the resonant frequency of the self-adaptive antenna 1102 as compared to the resonant frequency of the self-adaptive antenna 1102 when the electronic device 1100 is in an unfolded position (e.g., FIG. 10). However, electrodes 1110*a* and 1110*b* of the electronic device 1100 couple together inside of a hinge 1116 of the electronic device 1100 when the electronic device 1100 is folded in half, as shown. This truncation of the radiating length prevents the resonant frequency of the self-adaptive antenna 1002 from shifting off of a target frequency band when the electronic device 1000 is in the folded mode.

Figure 12:
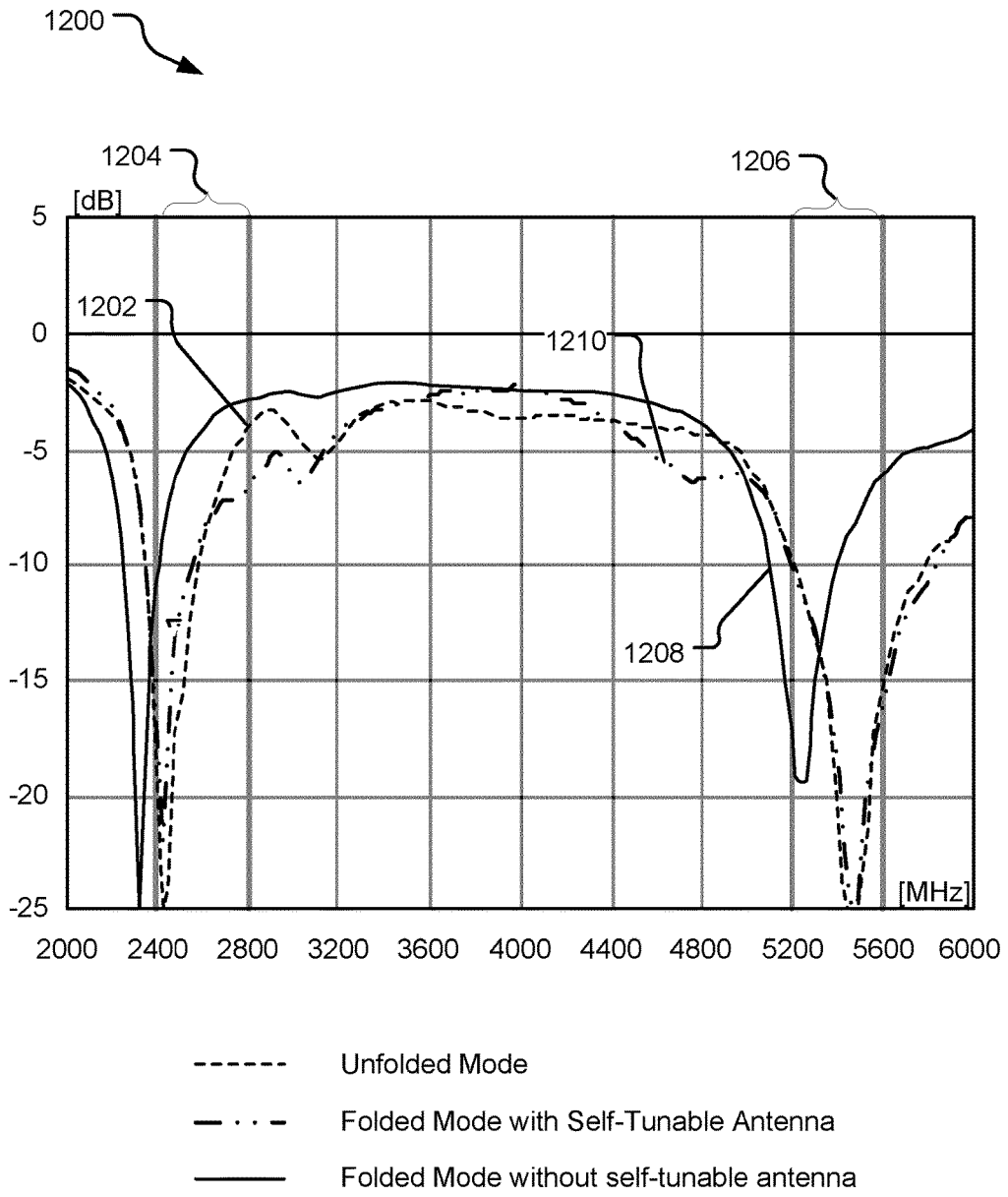
FIG. 12 illustrates a plot indicating performance of an example self-adaptive antenna and an example non-self-adaptive antenna in two identical electronic devices for various physical configurations of use.

FIG. 12 illustrates a plot 1200 indicating performance of an example self-adaptive antenna and an example non-self-adaptive antenna in two identical electronic devices for various physical configurations of use. A line 1202 illustrates identical performance of both of the self-adaptive antenna and the non-self adaptive antenna when the electronic devices are used in an unfolded mode, such as in the manner shown and described with respect to FIGS. 8 and 10. In the unfolded mode, resonance is observed in two target frequency bands 1204 and 1206. The lines 1208 and 1210 illustrate performance of the non-self-adaptive antenna and the self-adaptive antenna, respectively, when the electronic devices are folded in half, such as in the manner shown and described with respect to FIG. 9 or 11.

As shown by the line 1208, the non-self-adaptive antenna experiences peak resonances that are shifted off-center of target frequency bands 1204 and 1206 as a result of extra loading material placed in proximity to the self-adaptive antenna. As further shown by the line 1210, the self-adaptive antenna self-tunes when the electronic device is placed in the folded mode, maintaining the peak resonances in the target frequency bands 1204 and 1206.

Figure 13:
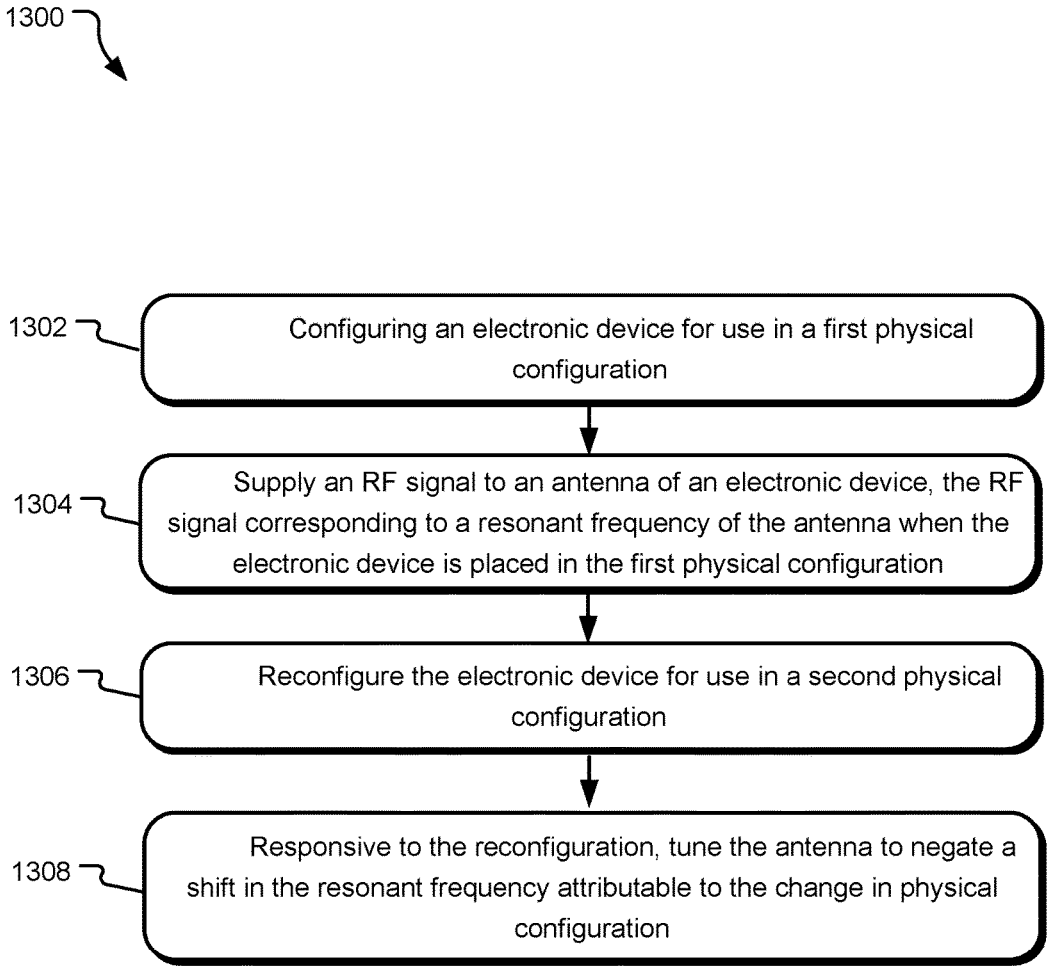
FIG. 13 illustrates example operations for using a self-adaptive antenna system for a reconfigurable electronic device.

FIG. 13 illustrates example operations 1300 for using a self-adaptive antenna system for a reconfigurable electronic device. A first configuration operation 1302 configures an electronic device for use in a first physical configuration. For example, the "first physical configuration" may refer to any of a number of various modes or positions in which the electronic device can be used including without limitation laptop mode, tablet mode, presentation mode, an open mode, a folded mode, etc.

A feed supply operation 1304 feeds an antenna of the self-adaptive antenna system with an RF signal corresponding to a resonant frequency of the antenna when the electronic device is placed in the first physical configuration. A reconfiguration operation 1306 reconfigures the electronic device for use in a second physical configuration. In some implementations, the reconfiguration operation 1306 entails turning, twisting, or rotating of a component of the electronic device. For example, the first physical configurations may be a tablet mode and the second physical configuration may be a laptop or presentation mode. In another implementation, the first physical configuration is an unfolded mode during which the electronic device can be used as a tablet and the second physical configuration is a folded mode during which the device can be used as a phone. Countless other implementations are also contemplated to which the disclosed technology is naturally extendable.

A tuning operation 1308 tunes the resonant frequency of the antenna responsive to the reconfiguring operation 1306. The tuning negates an observable shift in the resonant frequency of the antenna attributable to the change in physical configuration to ensure that the resonant frequency of the antenna corresponds to the RF signal applied via the feeding operation 1304 despite the changes to the physical configuration of the electronic device resulting from the reconfiguring operation 1306. In some implementations, the antenna is a multi band antenna and the tuning operation 1308 tunes the antenna in multiple frequency bands.

In one implementation, the tuning operation 1308 entails coupling a conductive radiating element of the antenna to a self-adaptive tuning element to alter a radiating length of the antenna. For example, coupling the conductive radiating element to the self-adaptive tuning element may alter a radiating length of the antenna by shifting a position of a feed point relative to the conductive radiating element. In another implementation, coupling the conductive radiating element to the self-adaptive tuning element adjusts a radiating length of the antenna by electrically connecting one or more additional conductive elements to the conductive radiating element. This adjustment may be designed to provide for either an increase or a decrease in the radiating length depending upon whether the resonance has been shifted up or down by the change in physical device configuration. In still another implementation, coupling the conductive radiating element to the self-adaptive tuning element increases or decreases a radiating length of the antenna by adding or removing an electrical short along a length of the conductive radiating element.

One example electronic device comprises an antenna that self-tunes resonant frequency responsive to changes to a physical configuration of the electronic device. Another electronic device of any previous example includes an antenna that self-tunes resonant frequency responsive to at least one of turning twisting, or rotating of a component of the electronic device.

Another example electronic device of any previous example includes an antenna that self-tunes resonant frequency responsive to maintain a resonant frequency within a same target frequency band despite the changes to the physical configuration of the electronic device. Still another example electronic device of any previous example includes an antenna that self-tunes by shifting position of a feed point relative to a radiating element, by altering a radiating length of the radiating element, or by creating or removing an electrical short along a length of the radiating element.

An example method includes supplying a radio frequency (RF) signal to an antenna of an electronic device, where the RF signal corresponds to a resonant frequency of the antenna when the electronic device is configured for use in a first physical configuration. The method further includes tuning the antenna to negate a shift in the resonant frequency attributable to a change in physical configuration of the electronic device in response to the change in physical configuration of the electronic device.

Another example method of any previous example method entails self-tuning the resonant frequency by adjusting a radiating length of the antenna. Still another example method of any previous example method entails self-tuning the resonant frequency by coupling a radiating element of the antenna to a self-adaptive tuning element.

According to another example method of any previous example method, self tuning an antenna entails coupling a radiating element to a self-adaptive tuning element, wherein the self-adaptive tuning element shifts a position of a feed point of the antenna, electrically couples to the radiating element to alter a radiating length of the radiating element, and/or creates or removes an electrical short along a length of the radiating element.

Another example method of any previous method of any previous example method entails reconfiguring an electronic device from a first physical configuration for use as a tablet computer to a second physical configuration for use as a laptop computer.

Still another example method of any previous example method entails self-tuning an antenna by at least one of turning, twisting, or rotating a component of the electronic device.

An example electronic device includes a means for self-tuning a radio frequency (RF) signal to an antenna. The RF signal corresponds to a resonant frequency of the antenna when the electronic device is configured for use in a first physical configuration. The electronic device further includes a means for tuning the antenna to negate a shift in the resonant frequency attributable to a change in physical configuration of the electronic device responsive to the change in physical configuration of the electronic device.

One example electronic device includes an antenna having a radiating element and a self-adaptive tuning element. The self-adaptive tuning element is configured to selectively couple with the radiating element in a first physical configuration of the electronic device to maintain a resonant frequency of the antenna within a same target frequency band despite a change in device configuration from a second physical configuration to the first physical configuration.

Another example electronic device of any previous example includes a radiating element that couples to a self-adaptive tuning element when the electronic device is in a first physical configuration and decouples the electronic device when the electronic device is in the second physical configuration.

Still another example electronic device of any previous example includes an antenna that self-tunes by shifting position of a feed point relative to a radiating element, by altering a radiating length of the radiating element, and/or by creating or removing an electrical short along a length of the radiating element.

The implementations of the invention described herein are implemented as logical steps in one or more computer systems. The logical operations of the present invention are implemented (1) as a sequence of processor-implemented steps executing in one or more computer systems and (2) as interconnected machine or circuit modules within one or more computer systems. The implementation is a matter of choice, dependent on the performance requirements of the computer system implementing the invention. Accordingly, the logical operations making up the embodiments of the invention described herein are referred to variously as operations, steps, objects, or modules. Furthermore, it should be understood that logical operations may be performed in any order, adding and omitting as desired, unless explicitly claimed otherwise or a specific order is inherently necessitated by the claim language.

The above specification, examples, and data provide a complete description of the structure and use of exemplary embodiments of the invention. Since many implementations of the invention can be made without departing from the spirit and scope of the invention, the invention resides in the claims hereinafter appended. Furthermore, structural features of the different embodiments may be combined in yet another implementation without departing from the recited claims.

What is claimed is:

1. An electronic device comprising:

an antenna including a radiating element having a physical length;

an electrical feed structure connected to the radiating element to supply a drive electrical current to the radiating element; and a self-tuning element connected to the radiating element that tunes a resonant frequency of the radiating element by creating or removing an electrical short between two points along the physical length of the radiating element, responsive to changes to a physical configuration of the electronic device.

2. The electronic device of claim 1, wherein the changes to the physical configuration of the electronic device occur responsive to at least one of turning, twisting, or rotating of a component of the electronic device.

3. The electronic device of claim 1, wherein the antenna self-tunes to maintain a resonant frequency within a same target frequency band despite the changes to the physical configuration of the electronic device.

4. The electronic device of claim 1, wherein the self-tuning element includes a first electrode located at a first point along the physical length of the radiating element and a second electrode located at a second point along the physical length of the radiating element, the first electrode and the second electrode being configured to create or remove an electrical short between the first point and the second point responsive to changes to the physical configuration of the electronic device.

5. The electronic device of claim 4, wherein the first electrode and the second electrode electrically couple, responsive to folding of the electronic device.

6. An electronic device comprising:

an antenna including a radiating element having a physical length;

an electrical feed structure connected to the radiating element to supply a drive electrical current to the radiating element; and a self-tuning element fixably connected to the radiating element and configured to create an electrical short between two points along the physical length of the radiating element in a first physical configuration of the electronic device to maintain a resonant frequency of the antenna within a same target frequency band despite a change in device configuration from a second physical configuration to the first physical configuration.

7. The electronic device of claim 6, wherein the self-tuning element includes a first electrode located at a first point along the physical length of the radiating element and a second electrode located at a second point along the physical length of the radiating element, the first electrode and the second electrode being coupled to create or remove an electrical short between the first point and the second point responsive to a change in device configuration from the second physical configuration to the first physical configuration.

8. The electronic device of claim 7, wherein the change in device configuration from the second physical configuration to the first physical configuration is a folding of the electronic device.

* * * * *